United States Patent [19]

Humpolik

[11] Patent Number: 4,574,444

[45] Date of Patent: Mar. 11, 1986

[54] METHOD FOR THE JOINING OF TUBULAR PARTS IN A HEAT EXCHANGER AND TOOL FOR PRACTICING THE METHOD

[75] Inventor: Bohumil Humpolik, Ludwigsburg, Fed. Rep. of Germany

[73] Assignee: Sueddeutsche Kuehlerfabrik, Julius Fr. Behr GmbH & Co. KG, Stuttgart, Fed. Rep. of Germany

[21] Appl. No.: 522,702

[22] Filed: Aug. 12, 1983

[30] Foreign Application Priority Data

Aug. 31, 1982 [DE] Fed. Rep. of Germany ..... 3232297

[51] Int. Cl.[4] ..... B21D 53/08

[52] U.S. Cl. ..... 29/157.3 C; 165/178; 29/157.4; 29/520; 29/508

[58] Field of Search ..... 165/173, 175, 178; 29/157.3 R, 157.4, 157.3 C, 520, 508, 521; 72/402, 404

[56] References Cited

U.S. PATENT DOCUMENTS 3,019,520 2/1962 Woolley ..... 29/520 X 3,921,281 11/1975 Hattori et al. ..... 29/520

*Primary Examiner*—Howard N. Goldberg

*Assistant Examiner*—John T. Burtch

*Attorney, Agent, or Firm*—Schwartz, Jeffery, Schwaab, Mack, Blumenthal & Evans

[57] ABSTRACT

The invention relates to a method for joining tubular parts of a heat exchanger that are inserted into each other, as well as to a tool for practicing the method.

2 Claims, 18 Drawing Figures

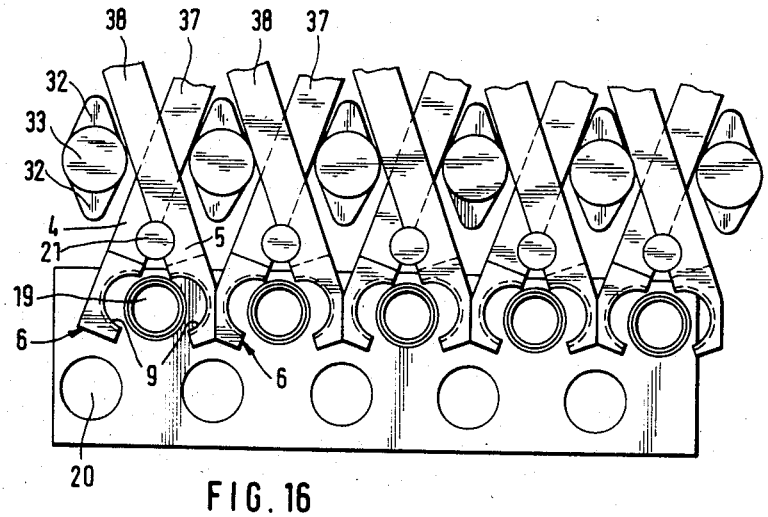
FIG. 16
FIG. 17
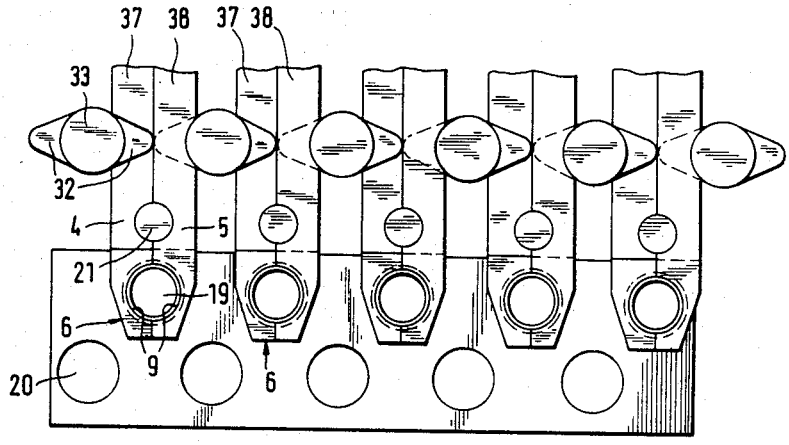

METHOD FOR THE JOINING OF TUBULAR PARTS IN A HEAT EXCHANGER AND TOOL FOR PRACTICING THE METHOD

BACKGROUND OF THE INVENTION

The present invention relates to a method for the joining of tubular parts in a heat exchanger that are inserted into each other, as well as to a tool for practicing the method.

German Offenlegungsschrift No. 23 32 241 describes a process for the joining of tubes that are inserted into each other, whereby the telescopically inserted tubes are deformed elastically by means of a shaping ring so that a sealing pressure acting in the radial direction is obtained in the area of the shaping ring between the inserted tube ends. The shaping ring has an orifice, the diameter of which is at least in one portion smaller than the diameter of the outer tubular part and is sufficiently strong to deform the tubular ends elastically in the radially inward direction. When the shaping ring is released, the tubular ends regain their original shape elastically and are thereby separated from each other.

Tube joining methods of this type are not suitable for large scale industrial production, since the application and the compression of each individual shaping ring is highly labor intensive and, consequently, expensive. Furthermore, the shaping element must remain in the area of the tube joint or otherwise the joint will separate. This has the disadvantage, especially in the case of heat exchangers for automotive vehicles, that the shaping elements remaining around the tube joint increase the weight of the heat exchanger, contrary to the requirements of the car manufacturer to reduce the weight.

SUMMARY OF THE INVENTION

It is therefore an object of the invention to provide an improved method for the joining of tubular parts in a heat exchanger that are inserted into each other.

It is also an object of the invention to provide a method wherein several tube joints may be created simultaneously and the weight of the heat exchanger reduced.

It is a further object of the invention to provide a tool for the execution of the claimed method.

In accomplishing the foregoing objects, there has been provided in accordance with one aspect of the present invention a method for joining tubular parts of a heat exchanger, comprising the steps of inserting a first inner tubular part into a second outer tubular part and radially inwardly deforming an area where the tubular parts are inserted by an amount sufficient to cause a plastic deformation of the outer tubular part and an at least partial elastic deformation of the inner tubular part. The radially inwardly deforming step of the process may include annularly surrounding the outer tubular part with a pressure element and then moving the pressure element axially over the area where the tubes are inserted. In addition, the deforming step may also include radially or tangentially moving the pressure element in an open state to the insertion area, closing and locking the pressure element around the outer tubular part, and, after axial movement, opening the pressure element and removing it from the insertion area.

A tool for practicing the method in accordance with the invention is also provided. One embodiment of such a tool comprises at least one pressure element comprising first and second segments, said segments being displaceable relative to each other and having a parting plane extending longitudinally, along which plane each segment provides a recess representing one section of an orifice formed when the pressure element is in a closed state, said orifice being capable of engaging tubular parts in a form-fitting manner; and means for moving the segments of the pressure element axially along telescopically inserted tubular parts.

In another embodiment, the tool is provided with locking means in the form of a ram or rams displaceable longitudinally relative to the pressure elements. A plurality of rams may be arranged in a comb like manner relative to a plurality of the pressure elements.

In still another embodiment of the present invention, a method is provided for joining tubular parts of a heat exchanger comprising the steps of placing a first tubular part end-to-end with a second tubular part, the tubular parts having circumferential grooves on their respective outer surfaces; moving a connecting tube into a position annularly surrounding the abutting ends of the tubular parts; and radially inwardly deforming an area where the tubular parts abut by an amount sufficient to cause a plastic deformation of the connecting tube into the circumferential grooves of the tubular parts.

BRIEF DESCRIPTION OF THE DRAWINGS

In the drawings:

FIGS. 16 and 17 show a variant of the embodiment depicted in FIG. 12, with scissors-like pressure elements portrayed in the open (FIG. 16) and closed state (FIG. 17), respectively.

DETAILED DESCRIPTION OF PREFERRED EMBODIMENTS

Figure 1:
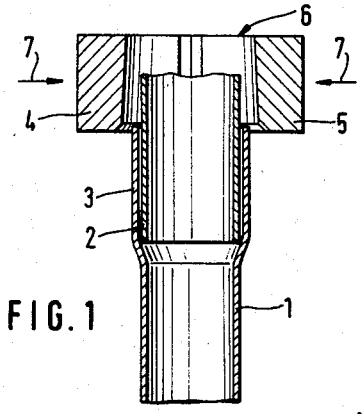
FIG. 1–4 show in cross section a sequence in accordance with the invention whereby a pair of tubular parts are joined.

The invention makes possible the joining in a simple manner of tubular heat exchanger parts that are inserted into each other, particularly the ends of heat exchanger tubes joined with the connecting fittings of a header plate or a connecting compartment (for example, the collector tank or cooling medium distributing and collecting tank of an evaporator), such that a plurality of tube connections may be effected simultaneously and the pressure elements are reusable. This has the advantage that the production of the heat exchanger takes place in a more economical fashion and the weight of the pressure elements is reduced.

The pressure element is preferably in two parts and is passed in the open state radially or tangentially into an area adjacent to the joint location over one of the tubes, then is closed and locked and, following the completion of the tube joint, it is unlocked and removed in the opposite direction. If the distance between two evaporator tubes is large enough so that the pressure elements for each tube joint may be introduced simultaneously, it is convenient to effect all of the tube joints of a row of tubes simultaneously. If the distance between two heat exchanger tubes is very small, it is proposed to form every second tube joint of a row of tubes in a first working step and subsequently to form the remaining joints of the same row in a second step.

In order to assure the appropriate functioning of the pressure element, means to lock the pressure element in the closing position are preferably provided. The two parts of the pressure element must be movable relative to each other for the insertion and removal of the tool, whereby it is possible to arrange the parts of the pressure element pivotingly or displacingly in the longitudinal and transverse directions. In such arrangements of the pressure elements, the means to lock the pressure elements generally consist of rams or specially-shaped elements set in the manner of a comb and designed to enter between two pressure elements, thereby wedging two adjacent pressure elements against each other.

A further arrangement of the pressure elements and locking means consist of designing the pressure elements in the form of scissor-like devices with the orifice of the pressure element being located on one side of the pivot point and actuating levers on the other side. The means to lock the tool are in the form of rotating cams, acting on the actuating levers.

The tool according to the invention may have different configurations depending on the type of the heat exchanger, wherein the pressure elements may have orifices with circular cross sections or with elliptical or oval cross sections, for use with heat exchangers with elliptical or oval tubes. To adapt the tool to a specific type of heat exchangers it is therefore necessary merely to replace the pressure elements with elements having the orifice with the necessary cross section; the arrangement remains unchanged otherwise. In order to obtain a uniform deformation of the tubes and automatic centering during the axial displacement of the pressure elements over the tubular parts, the orifice of the pressure elements has two axially successive conical sections opening in the same direction but with different angles relative to the axis of the tubes.

The method according to the invention and the tool for its execution will become more apparent from the following description of preferred embodiments, with the aid of the drawings.

In FIG. 1, two ends of tubes 1 and 2 are inserted into each other, with tube 1 having an expanded end 3. The length of expanded end 3 of tube 1 determines the length of insertion of tube 2 into tube 1. Symbols 4 and 5 designate two parts of a pressure element 6; the parts are arranged in the open state of the pressure element. Arrows 7 indicate the direction of motion of parts 4 and 5 of pressure element 6.

Figure 2:
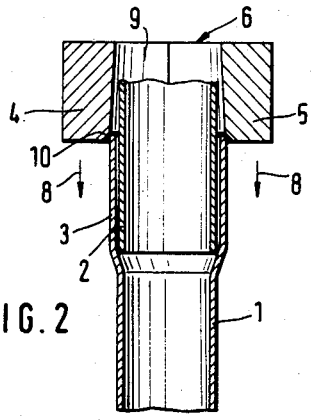

FIG. 2 shows tubes 1 and 2 in the perspective of FIG. 1.

Parts 4 and 5 of pressure element 6 are arranged in the closed state of the pressure element, producing a conical orifice 9 in pressure element 6. On the side facing the bell-like end 3, the conical orifice 9 has a cone 10 having an angle relative to the axis of expanded end 3 ("opening angle") that is greater than the opening angle of orifice 9, serving to center the tubes in the pressure element. Arrows 8 indicate the relative motion of the pressure element with respect to the tubes after the closing of parts 4 and 5 of pressure element 6. The diameter of conical orifice 9 is smaller on the side facing away from tube 1 than the outer diameter of expanded end 3.

Figure 3:
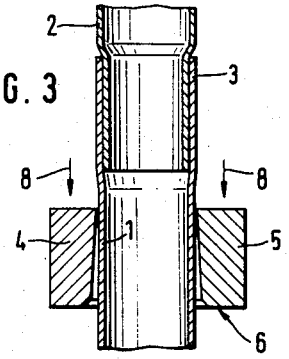

In FIG. 3 tubes 1 and 2 are shown after the deformation effected by the axial movement of pressure element 6. It is seen that the originally expanded end of the tube 1 is now deformed plastically in the radially inward direction, thereby compressing the inserted end of the tube 2. The end of the tube 2 is deformed in the radially inward direction, with this deformation being at least in part elastic, resulting in a strong press fit with the tube 1.

Figure 4:
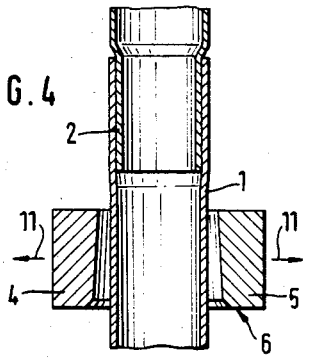

As seen in FIG. 4, after production of the tube joint, parts 4 and 5 of the pressure element are moved in the radially outward direction, indicated by the arrows 11; i.e., the pressure element 6 is opened and may be removed.

If a tube joint of this type is intended for evaporators or condensers of air-conditioning installations, it is appropriate to cover the end of the tube 2, to be inserted in the expanded end 3 of the tube 1, on its circumference with an adhesive, in order to obtain the tight fit required to contain the cooling medium. The adhesive is not necessary to increase the mechanical strength of the joint.

Figure 5:
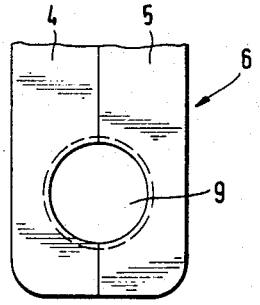
FIG. 5 is a top view of a pressure element used in the claimed process which has a circular orifice.

FIG. 5 shows a pressure element 6, consisting of two parts 4 and 5 and having a conical orifice 9, with the parting plane of the pressure element 6 passing through the center of said conical orifice 9.

Figure 6:
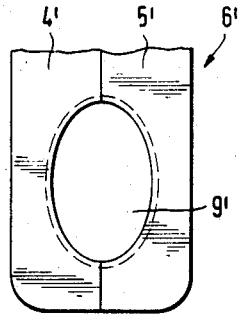
FIG. 6 is a top view of a pressure element used in the claimed process which has an elliptical orifice.

FIG. 6 shows a pressure element 6' for tube joints with elliptical cross sections, wherein the pressure element 6' consists of parts 4' and 5' and the parting plane passes along the principal axis of the orifice 9', which is elliptical in its cross section and conical in the axial direction.

Figure 7:
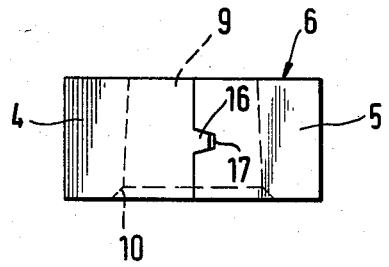
FIG. 7 is a front elevational view of two parts of a pressure element used in the claimed process.

FIG. 7 shows the front elevation view of a pressure element 6 with a conical orifice 9 and the stopping cone 10. Part 4 of pressure element 6 has in the parting plane a projection 16 directed toward opposing part 5, which projection engages a corresponding recess 17 in part 5, thereby forming a tight fit in the direction of the vertical axis of pressure element 6. In this manner, it is assured that parts 4 and 5 of the pressure element 6 in the closed state do not deviate in the direction of the vertical axis and that the conical orifice 9 is always accurately formed.

Figure 8:
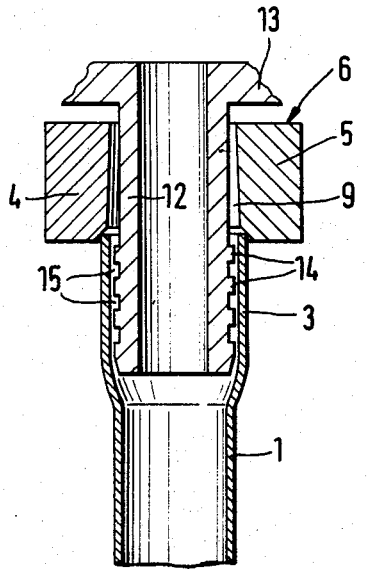
FIGS. 8 and 9 depict the process steps for creating a tube-header joint.

FIG. 8 shows a tube fitting of a header plate 3 of a heat exchanger, upon which an expanded end 3 of tube 1 is placed. On the circumference of tube fitting 12, several projections 14 extending in the circumferential direction are provided, such that grooves 15 are formed between them. Pressure element 6 is located between the bottom 13 and the expanded end 3 of tube 1, with parts 4 and 5 already closed and surrounding tube fitting 12 in an annular manner.

Figure 9:
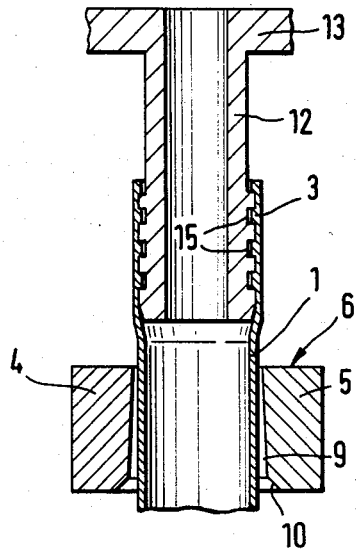

FIG. 9 shows the arrangement according to FIG. 8 after the axial displacement of pressure element 6. As described in connection with FIGS. 1–4, due to the difference in the conical orifice 9 in pressure element 6 relative to the external diameter of expanded end 3, a deformation of expanded end 3 in the radially inward direction takes place during the relative axial displacement of the pressure element. Because of the radial deformation, the material of expanded end 3 is partially squeezed into grooves 15, thereby creating a tight fit joint of the tube fitting 12 with the tube 1.

Figure 10:
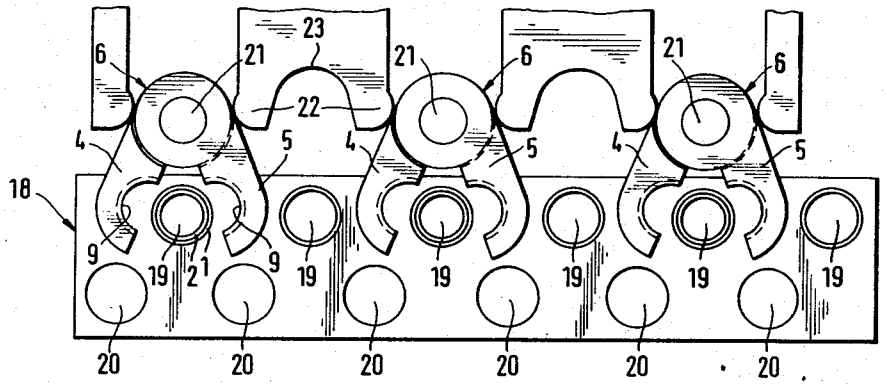
FIGS. 10 and 11 show a top view of a heat exchanger and a tool to produce rows of tube joints, with the tool's pressure elements in the open (FIG. 10) and closed state (FIG. 11), respectively.

FIG. 10 shows a top view of a heat exchanger 18, comprising two rows 19 and 20 of tubes. In row 19, tubes 1 and 2 are telescopically inserted into each other. The tool to produce the tube joints includes several pressure elements 6, with the number of pressure elements corresponding exactly to one-half the number of tubes in a row, and the arrangement is such that between two tubes associated with a pressure element there is always a tube without a pressure element.

Each pressure element 6 has two parts 4 and 5, supported pivotably in relation to each other on a shaft 21 and shown in FIG. 10 in their open position. Each of parts 4 and 5 has a recess 9. A ram 22 is located between every two of the pressure elements 6, which are in the extracted position, so that parts 4 and 5 of the pressure elements 6 may be pivoted apart. In this position the pressure elements may be moved against the tubes to be joined and removed after the completion of the joint. Expanding springs may be provided for the automatic pivoting apart of parts 4 and 5 after unlocking, said springs biasing parts 4 and 5 in the direction of the opening of the pressure elements 6.

Figure 11:
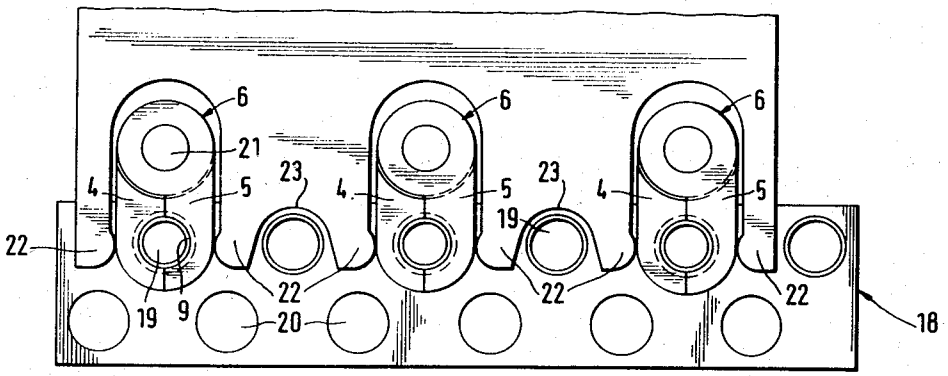

FIG. 11 illustrates a heat exchanger 18 according to FIG. 10, wherein the pressure elements 6 are closed, i.e., in the position producing the tube connections. The closing of the pressure elements 6 and the maintenance of their closed state during the production of the tube joints are effected by the rams 22 moving between the pressure elements 6 and performing the locking of pivoting parts 4 and 5. The rams 22 have recesses 23 to engage the tubes 19 located between two pressure elements 6.

As described in FIGS. 10 and 11, in a first working step only every second tube joint of row 19 of tubes is effected, and the remaining tube connections created in a subsequent second step. To produce the tube joints for row 20, the heat exchanger is suitably rotated, and the process described in regard to FIGS. 10 and 11 is repeated.

Figure 12:
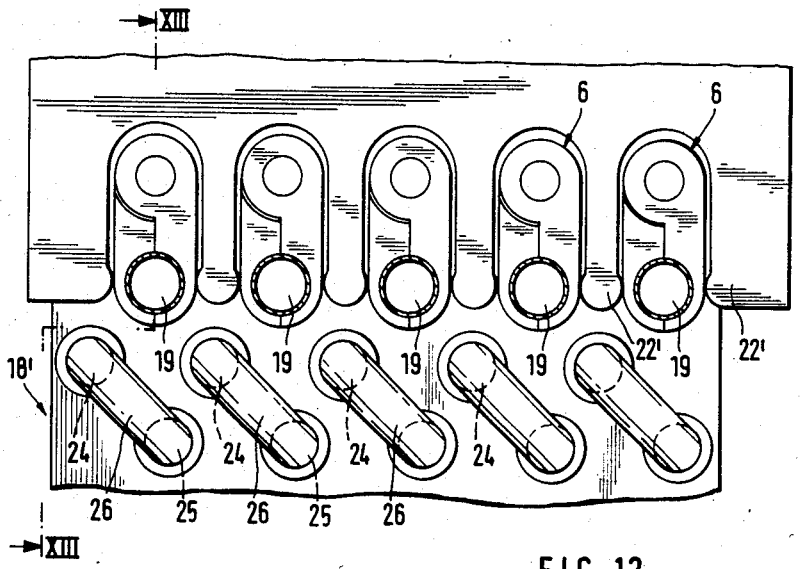
FIG. 12 shows a variant of the embodiment depicted in FIG. 11.

FIG. 12 shows a variant of the embodiment in FIG. 11, with a heat exchanger 18′ being displayed again in top view. The heat exchanger has several rows 19, 24, 25 of tubes, with an odd number of tubes in each row. Every tube 24 of the inner row is connected with one tube 25 of the following row by means of a tube bend 26, the tubes 24 and 25 being connected with the tube bends 26, for example, by brazing or by another known method. The tube joints of tubes 19 of the border row are produced by the process according to the invention and described hereinabove. FIG. 12 shows the pressure elements 6 in a closed state with rams 22′ in the position locking the pressure elements. In contrast to FIG. 11, in the case of the heat exchanger shown in FIG. 12, there is sufficient space between two adjacent tubes 19 to insert the pressure elements 6 of two adjacent tubes in an open state, so that with this configuration all of the tube joints of a row (19) may be produced in a single step.

Figure 13:
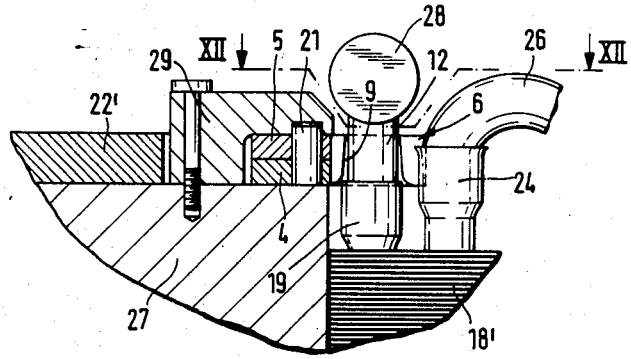
FIG. 13 is a cross section view on the line III—III in FIG. 12.

In FIG. 13 a section on the line XIII—XIII of FIG. 12 is represented. On the right side of FIG. 13 a part of the evaporator block 18′ is shown, with tubes 19 and 24 protruding from it. The end of tube 24 is connected with a tube bend 26. A connecting fitting 12 of the cooling medium distribution tank 28 is inserted in the expanded end of tube 19. A main body 27 of the tool is shown at the left side of FIG. 13; it is equipped with a shaft rotatably suporting parts 4 and 5 of the pressure element 6. To stabilize parts 4 and 5 in the axial direction, the upper part of shaft 21 is supported in a strap 9 screwed to the main body 27. On the upper edge of main body 27 of the tool, rams 22′ are arranged in a comb like manner and are displaceable in a longitudinal direction relative to the pressure elements. The two parts 4 and 5 of the pressure element surround connecting fitting 12, the diameter of which is slightly less than the smallest diameter of conical bore 9 of pressure element 6. The symbol XII—XII indicates the sectioning line followed by the view of FIG. 12.

To produce the joint between connecting fitting 12 and tube 19, the evaporator block is moved upwardly, whereby pressure element 6 is moved over the evaporator tube 19. As described in detail with regard to FIGS. 1–4, this process causes a radially inwardly directed deformation of tube 19 and an at least elastic deformation of fitting 12.

Figure 14:
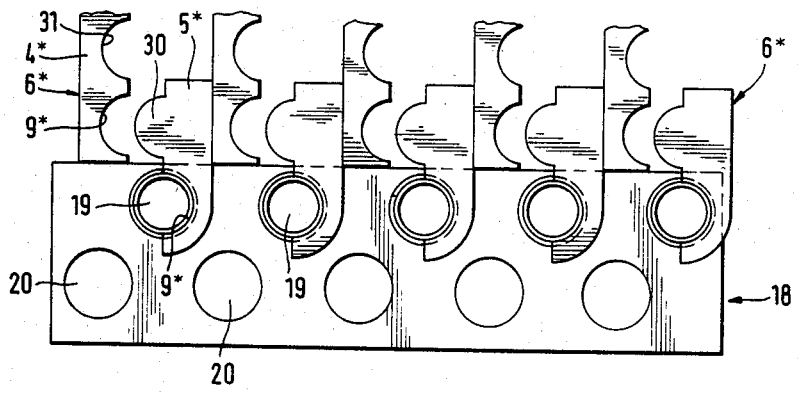
FIGS. 14 and 15 depict an elevated perspective like that of FIGS. 10 and 11, but with a different configuration of the tool's pressure elements.

FIG. 14 shows a top view of heat exchanger 18 with two rows 19 and 20 of tubes. Corresponding to the number of tubes in a row, pressure elements 6*, consisting of parts 4* and 5*, are provided. In the parting plane of each pressure element 6* there is always one-half of a conical orifice 9*, corresponding to orifice 9 as described with regard to FIGS. 10 and 11. In the parting plane, part 5* has a projection 30, while in part 4* a recess 31 is provided. The projection 30 and the recess 31 are arranged so that they engage each other in a tight fit when parts 4* and 5* form conical orifice 9* in the closed state of pressure elements 6*. Parts 4* and 5* are fastened to the tool so that they are supported displaceably in the longitudinal and the transverse directions, relative to each other. FIG. 14 shows the pressure element 6* in the open state, i.e., in the position wherein the tool may be introduced in the row of tubes and removed following the completion of the tube joints.

Figure 15:
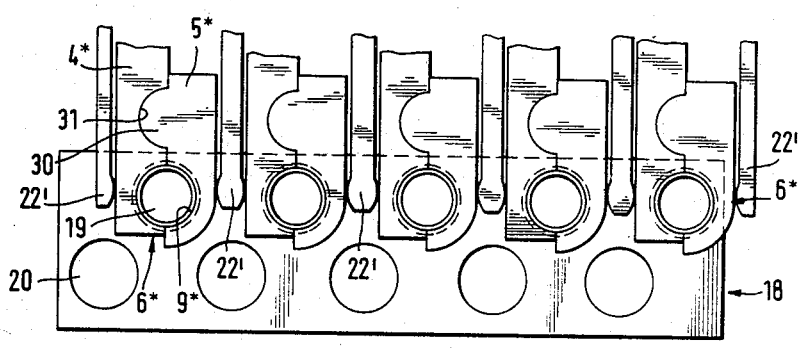

FIG. 15 shows the arrangement according to FIG. 14, with pressure elements 6* in the closing position. It is seen that in this position the projection 30 is completely engaged in recess 31 and that parts 4* and 5* engage each other in a tight fit. Pressure elements 6* form conical orifices 9*, by which the tubes to be joined are tightly surrounded. To immobilize pressure elements 6* in their closed position, punches 22′ are provided in a comb like arrangement so that they wedge the parts 4* and 5* against each other.

FIG. 16 shows a heat exchanger 18 comprising two rows 19 and 20 of tubes. The pressure elements 6 consist of parts 4 and 5 in a scissors-like arrangement, supported pivotingly on a shaft 21. On one side of the pivot formed by shaft 21, parts 4 and 5 each incorporate one-half of conical orifice 9. On the other side of the pivot, parts 4 and 5 of pressure elements 6 are extended in the form of actuating levers 37 and 38, which are acted on by rotating cams 32. Rotating canms 32 are arranged in pairs facing each other on a shaft 33, so that by an angular turn of 90° the pressure elements 6 may be moved from the closed position into the open position.

While FIG. 16 shows the pressure elements 6 in the open state, FIG. 17 displays the arrangement in the closed position. It is seen in FIG. 17 that the cams 32 are rotated by 90°, thereby clamping pressure elements 6. Two opposing cams 32 are arranged on shaft 33, and two cams 32 on a shaft 33 act on lever 37 of a pressure element 6 and on lever 38 of the next pressure element 6. The rotating cams 32 thereby clamp not only the individual parts 4 and 5 of pressure elements 6, but also two successive pressure elements 6 against each other.

Figure 18:
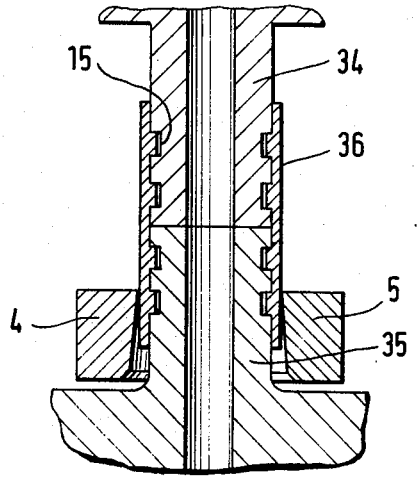
FIG. 18 presents in cross section an arrangement for joining two abutting tube fittings.

FIG. 18 demonstrates how two tube fittings, which, for example, due to their wall thickness, cannot be telescoped together, or which in view of their material properties cannot be deformed plastically, may still be joined together by the process according to the invention. FIG. 18 shows two tube ends 34 and 35, which are fitted end-to-end against each other. Tube ends 24 and 25 have circumferential grooves 15 on their peripheral surfaces, similar to the tube ends 12 in FIGS. 8 and 9. A connecting tube 36 is slid over tube end 34 and tube end 35. By means of the pressure element consisting of parts 4 and 5, connecting tube 36 is deformed plastically in an inward direction and thereby is squeezed into grooves 15.

What is claimed is:

1. A method for joining a plurality of closely spaced inner and outer tubular parts of a heat exchanger wherein either the plurality of inner tubular parts or the plurality of outer tubular parts are positioned in the same heat exchanger element, comprising the steps of:

(a) inserting said inner tubular parts into said outer tubular parts, thereby defining a plurality of first sections of said inner parts not surrounded by said outer parts, a plurality of joint regions in which one of said inner parts is surrounded by one of said outer parts, a plurality of first transitions between said first sections and said joint regions, a plurality of second sections of said outer parts which do not surround said inner parts, and a plurality of second transitions between said joint regions and said second sections;

(b) radially or tangentially moving a plurality of pressure elements to a position for annularly surrounding a plurality of said tubular parts, each pressure element having a conical pressure surface defined by a first opening having a larger diameter, a second opening having a smaller diameter, and a conical surface therebetween which extends substantially the entire length of the pressure element wherein said pressure elements are connected together to function simultaneously;

(c) closing said plurality of pressure elements to annularly surround the first sections of said plurality of inner parts and the first transitions thereof with said pressure elements, wherein said first openings are positioned substantially at said first transition;

(d) axially moving said plurality of pressure elements toward and along said joint regions so that the openings with the smaller diameter are moved along substantially the entire length of the joint regions whereby the conical pressure surfaces effect a radially inward plastic deformation of said outer part along each of said joint regions and an at least partial elastic deformation of said inner part along each of said joint regions; and (e) opening each said pressure element and moving it away from said tubular parts after said step of axially moving said pressure element, wherein each pressure element is moved past each said joint region and first transition before being opened.

2. A method according to claim 1, wherein said tubular parts are arranged in a row.

* * * * *